US011377622B2

(12) United States Patent
Stenger et al.

(10) Patent No.: US 11,377,622 B2
(45) Date of Patent: Jul. 5, 2022

(54) LIQUID DETERGENT COMPOSITIONS COMPRISING ALKYL ETHOXYLATED SULFATE SURFACTANT

(71) Applicant: The Procter & Gamble Company, Cincinnati, OH (US)

(72) Inventors: Patrick Christopher Stenger, Fairfield, OH (US); Meg Elizabeth Hall, Sunman, IN (US); Kathryn Mason Shrock, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 400 days.

(21) Appl. No.: 16/251,117

(22) Filed: Jan. 18, 2019

(65) Prior Publication Data

US 2019/0225914 A1 Jul. 25, 2019

Related U.S. Application Data

(60) Provisional application No. 62/619,262, filed on Jan. 19, 2018.

(51) Int. Cl.

| | |
|---|---|
| ***C11D 11/00*** | (2006.01) |
| ***C11D 1/14*** | (2006.01) |
| ***C11D 1/29*** | (2006.01) |
| ***C11D 1/37*** | (2006.01) |
| ***C11D 1/22*** | (2006.01) |
| ***C11D 3/37*** | (2006.01) |
| ***C11D 3/39*** | (2006.01) |

(52) U.S. Cl.

CPC ..... *C11D 1/146* (2013.01); *C11D 1/22* (2013.01); *C11D 1/29* (2013.01); *C11D 1/37* (2013.01); *C11D 3/3723* (2013.01); *C11D 3/3792* (2013.01); *C11D 3/3947* (2013.01)

(58) Field of Classification Search

CPC ..... C11D 11/0017; C11D 1/22; C11D 1/29; C11D 1/37; C11D 1/75; C11D 3/046; C11D 3/3723; C11D 1/146

See application file for complete search history.

(56) References Cited

U.S. PATENT DOCUMENTS

| | | | | |
|---|---|---|---|---|
| 6,001,787 | A * | 12/1999 | Pratley | A61Q 5/02 510/424 |
| 9,493,726 | B2 * | 11/2016 | Vinson | C11D 3/38645 |
| 2004/0030200 | A1 | 2/2004 | Zeller | |
| 2014/0349913 | A1 | 11/2014 | Delaney | |
| 2015/0322387 | A1 * | 11/2015 | Ohtani | A01N 31/16 424/408 |
| 2016/0060582 | A1 | 3/2016 | Ohtani et al. | |
| 2016/0340611 | A1 | 11/2016 | Scheibel et al. | |
| 2017/0175026 | A1 | 6/2017 | Sharko | |
| 2017/0175037 | A1 | 6/2017 | Sharko | |
| 2017/0253837 | A1 * | 9/2017 | Scheibel | C11D 17/003 |
| 2017/0335247 | A1 | 11/2017 | Fossum | |
| 2018/0195029 | A1 * | 7/2018 | Delaney | C11D 1/22 |
| 2019/0002796 | A1 | 1/2019 | Vinson | |

FOREIGN PATENT DOCUMENTS

| | | | |
|---|---|---|---|
| CN | 101115825 | A | 1/2008 |
| CN | 106574209 | A | 4/2017 |
| WO | WO2006080913 | A1 | 8/2006 |
| WO | WO2006088928 | A1 | 8/2006 |
| WO | WO2009143091 | A1 | 11/2009 |

OTHER PUBLICATIONS

15096 PCT Search Report for app. No. PCT/US2019/014187, dated Apr. 14, 2019, 14 pages.

Zhiqiang Jin et al: "Synthesis and 1-15 Properties of Anionic Surfactants Containing Oxyethylene Group or/andBranched Tail", Journal of Dispersion Science and Technology., vol. 32, No. 6, Jun. 1, 2011 (Jun. 1, 2011), pp. 898-902, XP055565564, New York, NY, USISSN: 0193-2691, 001: 10.1080/01932691003756720 3.2 Krafft Points of New Anionic Surfactants;p. 900-p. 901; table 2.

* cited by examiner

*Primary Examiner* — Necholus Ogden, Jr.

(57) ABSTRACT

Liquid detergent composition including a surfactant system, the surfactant system including alkyl ethoxylated sulfate (AES) surfactant. Detergent pastes comprising AES surfactant. Related processes.

19 Claims, No Drawings

LIQUID DETERGENT COMPOSITIONS COMPRISING ALKYL ETHOXYLATED SULFATE SURFACTANT

FIELD OF THE INVENTION

The present disclosure relates to liquid detergent composition that include a surfactant system, where the surfactant system includes alkyl ethoxylated sulfate (AES) surfactant. The present disclosure also relates to detergent pastes that include AES surfactant. The present disclosure also relates to related processes.

BACKGROUND OF THE INVENTION

The detergent manufacturer is always seeking to improve the cleaning performance and/or aesthetics of his or her liquid detergent compositions. Surfactants are the typical cleaning workhorse of such compositions, and anionic surfactants such as alkyl ethoxylated sulfate (AES) surfactant are common. Compositions that include relatively low levels of surfactant (e.g., less than 20 wt %) present particular challenges.

For example, compositions that are relatively low in surfactant may appear thin or runny to the consumer, connoting low quality and/or poor performance The viscosity of such compositions may be increased by adding external thickeners, such as salts or structurants, but the use of such materials result in additional cost without providing additional detergency benefits.

Additionally, it has been found that the cleaning benefits of certain liquid detergent compositions may be improved (for example, greasy soil removal) by formulating with AES surfactant that has relatively increased alkyl chain lengths (e.g., C14 or greater). However, average AES chain lengths (which may be reflected in the weight average molecular weight of alcohols having those chain lengths) that are too long can result in poor physical stability of the detergent composition.

There is a continued need to provide improved liquid detergent compositions that provide good performance, viscosity, and/or stability profiles.

SUMMARY OF THE INVENTION

The present disclosure relates to liquid detergent compositions that includes alkyl ethoxylated sulfate having particular alkyl chain lengths, namely fifteen carbons in the alkyl chain.

For example, the present disclosure relates to a liquid detergent composition that includes: from about 5% to less than 20%, by weight of the detergent composition, of a surfactant system, the surfactant system including alkyl ethoxylated sulfate ("AES") surfactant and a second surfactant, where the AES surfactant includes a plurality of AES compounds, where each AES compound comprises an alkyl chain, where the AES surfactant includes from about 40 wt % to about 70 wt %, by weight of the AES surfactant, of an AES compound having fifteen carbon atoms in the alkyl chain ("C15 AES"), where the AES surfactant includes no more than about 30 wt %, by weight of the AES surfactant, of an AES compound having fourteen carbon atoms in the alkyl chain ("C14 AES"), where the AES surfactant is characterized by chain lengths having a weight average molecular weight ("MW") of from about 200 to about 220 daltons, based on the MW of a fatty alcohol comprising the alkyl chain; and a detergent adjunct.

The present disclosure also relates to a liquid detergent composition that includes: a surfactant system, the surfactant system including AES surfactant and a second surfactant, where the AES surfactant comprises a plurality of AES compounds, where each AES compound comprises an alkyl chain, where the AES surfactant includes from about 40 wt % to about 70 wt %, by weight of the AES surfactant, of C15 AES, where the AES surfactant includes no more than about 30 wt %, by weight of the AES surfactant, of C14 AES, where the AES surfactant is characterized by chain lengths having a weight average molecular weight of from about 208 to no greater than 215 daltons, based on the MW of a fatty alcohol comprising the alkyl chain, where the AES surfactant is further characterized by an average degree of ethoxylation of from about 0.5 to about 5; and a detergent adjunct.

The present disclosure also relates to a detergent paste that includes: from about 45% to about 100%, by weight of the paste, of AES surfactant, where the AES surfactant comprises a plurality of AES compounds, where each AES compound comprises an alkyl chain, wherein the AES surfactant comprises from about 40 wt % to about 70 wt %, by weight of the AES surfactant, of C15 AES, where the AES surfactant comprises no more than about 30%, by weight of the AES surfactant, of C14 AES, where the AES surfactant is characterized by chain lengths having a weight average molecular weight of from about 200 to about 220 daltons, based on the MW of a fatty alcohol comprising the alkyl chain, where the AES surfactant is further characterized by an average degree of ethoxylation of from about 0.5 to about 5; optionally, the paste further includes alkyl benzene sulphonate surfactant, a caustic agent, an alkoxylated polyalkyleneimine (PEI) polymer, non-aminofunctional organic solvent, water, or combinations thereof.

The present disclosure also relates to related processes.

DETAILED DESCRIPTION OF THE INVENTION

The present disclosure relates to liquid detergent compositions that comprise a particular blend of alkyl ethoxylated sulfate (AES) surfactant compounds. In particular, it has been found that careful selection of AES having certain alkyl chain length distributions can provide improved viscosity, cleaning performance, and/or stability. For example, AES that has certain amounts of C15 alkyl chains and a certain weight average molecular weight of alkyl chains (e.g., from about 200 to about 220 daltons) has been found to improve viscosity in liquid detergent compositions, particularly in those that have relatively low amounts of surfactant (e.g., less than 20 wt %).

Without wishing to be bound by theory, it is believed that balancing the more-hydrophobic longer chains (e.g., C15) with the less-hydrophobic shorter chains (e.g., C13) results in an effective AES material that has surprising effects on the viscosity of certain liquid detergent compositions. Additionally, it is expected that such compositions would provide the same or improved cleaning performance on certain soils (e.g., greasy soils) due to the increased amount of longer-chained AES compared to AES surfactants having the same or lower weight average molecular weights.

The compositions and processes of the present disclosure are described in more detail below.

As used herein, the articles "a" and "an" when used in a claim, are understood to mean one or more of what is claimed or described. As used herein, the terms "include," "includes," and "including" are meant to be non-limiting.

The compositions of the present disclosure can comprise, consist essentially of, or consist of, the components of the present disclosure.

The terms "substantially free of" or "substantially free from" may be used herein. This means that the indicated material is at the very minimum not deliberately added to the composition to form part of it, or, preferably, is not present at analytically detectable levels. It is meant to include compositions whereby the indicated material is present only as an impurity in one of the other materials deliberately included. The indicated material may be present, if at all, at a level of less than 1%, or less than 0.1%, or less than 0.01%, or even 0%, by weight of the composition.

As used herein the phrase "fabric care composition" includes compositions and formulations designed for treating fabric. Such compositions include but are not limited to, laundry cleaning compositions and detergents, fabric softening compositions, fabric enhancing compositions, fabric freshening compositions, laundry prewash, laundry pretreat, laundry additives, spray products, dry cleaning agent or composition, laundry rinse additive, wash additive, post-rinse fabric treatment, ironing aid, unit dose formulation, delayed delivery formulation, detergent contained on or in a porous substrate or nonwoven sheet, and other suitable forms that may be apparent to one skilled in the art in view of the teachings herein. Such compositions may be used as a pre-laundering treatment, a post-laundering treatment, or may be added during the rinse or wash cycle of the laundering operation.

Unless otherwise noted, all component or composition levels are in reference to the active portion of that component or composition, and are exclusive of impurities, for example, residual solvents or by-products, which may be present in commercially available sources of such components or compositions.

All temperatures herein are in degrees Celsius (° C.) unless otherwise indicated. Unless otherwise specified, all measurements herein are conducted at 20° C. and under the atmospheric pressure.

In all embodiments of the present disclosure, all percentages are by weight of the total composition, unless specifically stated otherwise. All ratios are weight ratios, unless specifically stated otherwise.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Liquid Detergent Composition

The present disclosure relates to liquid detergent compositions. The detergent compositions may comprise surfactant systems, which are discussed in more detail below.

The liquid detergent composition may be a household care product, such as a fabric care composition or a dish care composition. The detergent composition may be selected from the group of light duty liquid detergents compositions, heavy duty liquid detergent compositions, hard surface cleaning compositions (such as hand or automatic dishwashing compositions), laundry additives, and mixtures thereof. The detergent composition may be selected from a hard surface cleaning composition (such as a dishwashing composition), a fabric care composition (such as a heavy duty liquid detergent composition), or a mixture thereof.

The liquid detergent composition may have a viscosity from about 1 to about 2000 centipoise (1-2000 mPa·s), or from about 200 to about 1400 centipoise, or from about 200 to about 1000 centipoise, or from about 200 to about 800 centipoise (200-1400 mPa·s). The viscosity is determined using a Brookfield viscometer, No. 2 spindle, at 60 RPM/s, measured at 20° C.

The liquid detergent composition may be isotropic. The liquid detergent composition may be relatively transparent or translucent. The detergent compositions of the present disclosure may be characterized by a percent transmittance of greater than about 50%, or greater than about 60%, or greater than about 80%, or greater than about 90%, at a wavelength of 570 nm measured at room temperature via a standard 10 mm pathlength cuvette with a Beckman DU spectrophotometer using deionized water as blank, in the absence of dyes and/or opacifiers. Percent transmittance is determined according to the method provided in the Test Methods section.

The liquid detergent composition may be characterized by a pH of from about 6.5 to about 9, or from about 7 to about 9, or from about 7.5 to about 8.5. pH is measured according to the method provided in the Test Methods section.

The liquid detergent composition may comprise a surfactant system and a detergent adjunct. These components are described in more detail below.

The present disclosure contemplates an array of liquid detergent compositions, each of which contains AES according to the present disclosure, where a first liquid detergent composition comprises a relatively high amount of total surfactant (e.g, greater than 20% by weight of the composition), and where a second liquid detergent composition comprises a relatively low amount of total surfactant (e.g., less than 20% by weight of the composition). The array may be present in a display or store shelf. The first and second liquid detergents may be near each other, e.g., within 3 meters, or within 2 meters, or within 1 meter.

Surfactant System

The detergent compositions of the present disclosure comprise a surfactant system. The surfactant system may comprise two or more detersive surfactants suitable for the intended end-use of the detergent composition.

The detergent composition may include any suitable amount of surfactant. The detergent composition may include from about 1% to about 60%, or from about 5% to about 50%, or from about 8% to about 40%, by weight of the composition, of the surfactant system. The detergent composition may include from about 5% to about 20%, or about 5% to about 17%, or from about 8% to about 15%, or from about 10% to about 15%, by weight of the detergent composition, of the surfactant system. The detergent compositions may be relatively low in surfactant (e.g., less than 20 wt %), which may be cost-efficient.

The surfactant system may comprise alkyl ethoxylated sulfate (AES) surfactant and a second surfactant, which are described in more detail below.

Alkyl Ethoxylated Sulfate Surfactant (AES)

The detergent compositions and/or surfactant systems of the present disclosure include alkyl ethoxylated sulfate (AES) surfactant. AES surfactant may be a major component of the surfactant system, meaning that there is more AES surfactant present than any other single surfactant. The detergent compositions and/or surfactant systems of the present disclosure may include at least about 30%, or from about 40%, or from about 50%, or from about 60%, by weight of the surfactant system, of AES surfactant. The detergent compositions may include from about 3%, or from about 5%, or from about 8%, or from about 10%, to about 19%, or to about 17%, or to about 15%, or to about 12%, or to about 10%, by weight of the detergent composition, of AES surfactant.

The AES surfactant comprises a plurality of AES compounds, where each AES compound comprises an alkyl chain. The alkyl chain of a particular AES compound may be characterized by the total number of carbons in the alkyl portion, otherwise known as the alkyl chain lengths. A given amount of AES surfactant may include a variety of AES compounds having chain lengths that fall within certain proportions or distributions. Thus, a given amount or sample of AES may be characterized by distributions of AES compounds having certain chain lengths, and/or by a weight average number of carbons in the alkyl portion.

Commercially available AES surfactants may include AES having weight average chain lengths of from twelve to fifteen, known as C12-15 AES, or chain lengths of from twelve to fourteen, known as C12-14 AES. These AES surfactants may include at least some AES compounds having chain lengths of fifteen, but are typically characterized by a relatively wide and varied distribution of other chain lengths as well.

In contrast, the AES surfactant of the present disclosure may include a relatively high proportion of an AES compound having fifteen carbon atoms in the alkyl chain ("C15 AES"). C15 AES may be desirable because the relatively longer alkyl chain increases the hydrophobicity of the AES surfactant, which may provide improved soil removal, such as greasy soil removal. The AES surfactant may include from about 40 wt %, or from about 45 wt %, to about 70 wt %, or to about 60 wt %, by weight of the AES surfactant, of C15 AES. C15 AES may make up a major portion of the AES surfactant, meaning that there is more C15 AES surfactant by weight present than any other single type of AES surfactant. C15 AES may make up at least half, or even a majority, of the AES surfactant by weight.

The AES surfactant of the present disclosure may include an AES compound having fourteen carbon atoms in the alkyl chain ("C14 AES"), for example at least about 1 wt %, by weight of the AES surfactant, of C14 AES. The AES surfactant may include relatively limited amounts of C14 AES. For example, the AES surfactant may contain no more than about 30 wt %, or no more than about 25 wt %, or no more than about 20 wt %, or no more than about 15 wt %, or no more than about 10 wt %, by weight of the AES surfactant, of C14 AES. When a composition or surfactant system comprises a relatively large proportion of C15 AES, it may be desirable to limit the amount of C14 AES, e.g., for stability reasons.

The AES surfactant of the present disclosure may include AES compound having twelve carbon atoms in the alkyl chain ("C12 AES"), an AES compound having thirteen carbon atoms in the alkyl chain ("C13 AES"), or mixtures thereof. The AES surfactant may include a mixture of C12 AES and C13 AES. The AES surfactant may include from about 25% to about 50%, or from about 30 wt % to about 40 wt %, by weight of the AES surfactant, of a mixture of C12 AES and C13 AES. AES having relatively shorter chain lengths (e.g., twelve and/or thirteen carbons) may help to counterbalance the hydrophobicity of the C15 AES, for example resulting in a broader cleaning profile and/or a better stability profile. Additionally or alternatively, the presence of, e.g., C12 AES and/or C13 AES may help to relatively decrease the weight average molecular weight of the chain lengths of the AES surfactant (e.g., to from about 200 to about 220 daltons).

The AES surfactant of the present disclosure may include an AES compound having thirteen carbon atoms in the alkyl chain ("C13 AES"). C13 AES may be desirable because the relatively shorter alkyl chain decreases the relative hydrophobicity of the AES surfactant, enabling it to remove different soils and/or be relatively more physically stable than a more hydrophobic AES surfactant. The AES surfactant may include from about 15 wt %, or from about 20 wt %, or from about 25 wt %, to about 50 wt %, or to about 40 wt %, or to about 35 wt %, by weight of the AES surfactant, of C13 AES, preferably from about 15 wt % to about 35 wt %. C13 AES may be present as the first- or second-most prevalent AES compound in the AES surfactant; for example, the AES surfactant may be richest in C15 AES and C13 AES, having relatively high levels of both compared to AES of other chain lengths.

The AES surfactant of the present disclosure may include an AES compound having twelve carbon atoms in the alkyl chain ("C12 AES"). The AES surfactant may contain at least about 1 wt %, or at least about 3 wt %, or at least about 5 wt %, or at least about 10 wt % of C12 AES. The AES surfactant may contain no more than about 20 wt %, or no more than about 15 wt %, or no more than about 12 wt %, or no more than about 10 wt %, or no more than about 5 wt %, of C12 AES. The AES surfactant may contain from about lwt %, or from about 3 wt %, to about 20 wt %, or to about 15 wt %, by weight of the AES surfactant, of C12 AES, preferably from about 3 wt % to about 15 wt %. C12 AES may be desirable, for example, to counterbalance the hydrophobicity of the C15 AES, resulting in a broader cleaning profile and/or a better stability profile.

The AES surfactant of the present disclosure may include at least 1 wt %, by weight of the AES surfactant, of each of C12 AES, C13 AES, and C14 AES surfactant, in addition to the amounts of C15 surfactant recited above. The AES surfactant of the present disclosure may comprise from about 30 wt % to about 60 wt %, by weight of the AES surfactant, of C12 AES, C13 AES, C14 AES, or mixtures thereof, preferably mixtures thereof.

The AES surfactant of the present disclosure may comprise from about lwt % to about 20 wt % C12 AES, from about 25 wt % to about 50 wt % C13 AES, from about 1 wt % to about 10 wt % C14 AES, and from about 45 wt % to about 60 wt % C15 AES, wherein each wt % is by weight of the AES surfactant, and may be characterized by alkyl chain lengths having an average molecular weight of from about 205 to about 220, preferably from about 208 to about 218; the provided wt %'s may add up to from about 95 wt % to about 100 wt %.

The AES surfactant of the present disclosure may include an AES compound having sixteen carbon atoms in the alkyl chain ("C16 AES"). The amounts of C16 present may be limited, for example, because the longer chain length may contribute to phase instability. The AES surfactant of the present disclosure may comprise from about 0.1%, by weight of the AES surfactant, to less than about 5%, or less than about 3%, or less than about 1.5%, or less than 1%, by weight of the AES surfactant, of C16 AES.

The AES surfactant of the present disclosure may be characterized by the weight average molecular weight of the chain lengths of the AES compounds in the distribution. The AES surfactant as a whole may be characterized by weight average molecular weight chain lengths that are lower than might be expected in view of the relatively high proportion of C15 AES.

The weight average molecular weight of the chain lengths may be determined by finding the weight average molecular weight of a fatty alcohol consisting of the alkyl chain and a hydroxyl group. Calculating the molecular weight of the chain lengths in such a fashion can present several advantages. For example, AES surfactants are typically synthesized from such fatty alcohols, which serve as a feedstock material before being alkoxylated (e.g., ethoxylated) and sulfated to arrive at the final AES compound(s). Thus, relevant information relating to the fatty alcohol feedstock is typically available from the feedstock supplier and/or the AES manufacturer. Additionally, reporting molecular weight based on a fatty alcohol comprising the alkyl chain rather than the molecular weight of the AES surfactant itself helps to remove uncertainty resulting from variable alkoxylation; for example, a C15 AES material may include some molecules that include one mole of ethoxylation, and others that include two moles and/or three moles of ethoxylation.

For example, the molecular weight of the alkyl chain of a C15 AES compound is based on a C15 fatty alcohol, which may have the following empirical formula: $C_{15}H_{31}OH$. Such a C15 fatty alcohol has a molecular weight of about 228 daltons. For convenience, Table 1 shows the molecular weight of several exemplary fatty alcohols.

TABLE 1

| Fatty Alcohol, by carbon chain length | Molecular Weight (in daltons) |
|---|---|
| C12 fatty alcohol | 186 |
| C13 fatty alcohol | 200 |
| C14 fatty alcohol | 214 |
| C15 fatty alcohol | 228 |
| C16 fatty alcohol | 242 |

The AES surfactant of the present disclosure may be characterized by chain lengths having a weight average molecular weight of from about 200, or from about 205, or from about 208, or from about 210, or from about 211, from about 214, to about 220, or to about 218, or to about 215 daltons, wherein the molecular weight of a particular alkyl chain is based on the molecular weight of fatty alcohol comprising the alkyl chain (i.e., a fatty alcohol consisting of the alkyl chain and a hydroxyl group). The AES surfactant may be characterized by chain lengths having a weight average molecular weight of from about 200 to about 220, or from about 210 to about 220, or from about 211 to about 218 daltons. The AES surfactant may be characterized by chain lengths having a weight average molecular weight of from about 208 to no greater than 215 daltons. AES characterized by chain lengths of a relatively lower weight average molecular weight (e.g., 208-215 daltons) may be particularly preferred in detergent compositions having relatively higher amounts of surfactant (e.g., more than 20 wt %), as they facilitate improved physical stability.

AES surfactant may be characterized by their degrees of ethoxylation. In a population of AES compounds, the AES molecules may have varying degrees of ethoxylation. Thus, a given amount or sample of AES may be characterized by a weight average degree of ethoxylation, where the degree of ethoxylation is reported as moles of ethoxy groups ($—O—CH_2—CH_2$) per mole of AES. The AES surfactant of the present disclosure may be characterized by a weight average degree of ethoxylation of from about 0.5 to about 5, or from about 1 to about 3, or from about 1.5 to about 2.5. When the amount of linear alkyl benzene sulfonate surfactant in the surfactant system is low or non-existent, it may be preferred for the surfactant systems to include AES having a relatively low degree of ethoxylation, as such AES may provide grease cleaning benefits.

The AES may include at least some alkyl sulfate ("AS") surfactant that is not ethoxylated. The unethoxylated AS may be present as a result of incomplete reactions during the ethoxylation process, and/or because it was added a separate ingredient. For the purposes of the present disclosure, (unethoxylated) AS is considered to be part of the AES surfactant when determining levels, chain length molecular weights, and/or degrees of ethoxylation.

The AES surfactant may comprise AES compounds having linear alkyl chains, AES compounds having branched alkyl chains, or mixtures thereof. The AES surfactant may comprise AES surfactant that is branched at the C2 position, where the C2 is the second carbon away from the ethoxy sulfate head group (i.e., the carbon adjacent the ethoxy sulfate head group is at the C1 position). The AES surfactant may comprise from about 10% to about 30%, by weight of the AES surfactant, of AES surfactant that is branched at the C2 position. Branched alkyl chains may improve and/or broaden the cleaning profile of the AES surfactant. It may also be that linear alkyl portions of the AES compounds are preferred. At least about 50%, or at least about 75%, or at least about 90%, or at least about 95%, or about 100%, by weight of the AES surfactant, of the AES compounds may have alkyl chains that are linear alkyl chains. The AES may comprise a mixture of C15 AES compounds, where at least 60%, by weight of the C15 AES, of the C15 AES is linear, and at least 10%, by weight of the C15 AES, of the C15 AES is branched, preferably at the C2 position. The AES may comprise a mixture of C13 AES compounds, where at least 60%, by weight of the C13 AES, of the C13 AES is linear, and at least 10%, by weight of the C13 AES, of the C13 AES is branched, preferably at the C2 position.

As described above, AES compounds are typically manufactured by sulfating an ethoxylated fatty alcohol. A fatty alcohol may first be provided, then ethoxylated according to known methods. Thus, AES compounds, or at least the alkyl chains of the AES compounds, may be described in terms of the sources, for example oils or fatty alcohols, from which they are derived. The AES compounds of the present disclosure may include alkyl chains that are derived from a non-petroleum source, preferably from a natural source. The AES of the present disclosure may include mixtures of AES that includes alkyl chains that are naturally derived and AES that includes alkyl chains of AES that are synthetically derived (e.g., petrol-derived); such mixtures may be useful to account for supply chain variations, disruptions, and/or pricing fluctuations, e.g. so that a shortage of one type of AES may be back-filled by another type.

Natural sources may include oils derived from plants or animal sources, preferably from plants. Representative non-limiting examples of vegetable oils include canola oil, rapeseed oil, coconut oil, corn oil, cottonseed oil, olive oil, palm oil, peanut oil, safflower oil, sesame oil, soybean oil, sunflower oil, linseed oil, palm kernel oil, tung oil, jatropha oil, mustard oil, pennycress oil, camelina oil, castor oil, or mixtures thereof. Suitable feedstock oils may include metathesized oils, typically formed from a metathesis reaction in the presence of a suitable metathesis catalyst. The alkyl portion may be derived from coconut oil, palm kernel oil, or mixtures thereof, preferably from coconut oil, palm kernel oil, or mixtures thereof. Such sources may be desirable for environmental and/or sustainability reasons, as they do not rely on fossil fuels. Further, the alkyl chains of AES compounds derived from natural sources typically contain an even number of carbon atoms.

Other sources of alkyl chains (e.g., feedstock alcohols) may include commercially available alcohols, such as those sold by Shell (e.g., under the Neodol™ tradename, for example Neodol™ 23, Neodol™ 3, Neodol™ 45, and/or Neodol™ 5) and/or Sasol (e.g., Lial™, Isalchem™, Safol™, etc.).

It may be that the AES of the present disclosure is not derived from a Fischer-Tropsch process. It may be that the AES of the present disclosure is derived from the well-known Shell modified oxo process. The AES of the present disclosure may include AES that is derived from the Ziegler process.

The AES of the present disclosure may be present in acid form, in salt form (e.g., neutralized), or mixtures thereof. The salt-form AES may be an alkali metal salt, preferably a sodium salt, an ammonium salt, or an alkanolamine salt.

Second Surfactant

The detergent compositions and/or surfactant systems of the present disclosure may include at least a second surfactant in addition to the AES. The second surfactant may be derived from a non-petroleum source, preferably from a natural source. Suitable natural sources are described above.

The second surfactant may be present in the surfactant system at a level of about 0.1% to about 90%, or from about 0.1% to about 75%, or from about 20% to about 50%, by weight of the surfactant system. The second surfactant may be present in the detergent composition at a level of about 1% to about 50%, or from about 5% to about 40%, or from about 10% to about 30%, or from about 15% to about 25%, by weight of the detergent composition.

The second surfactant may be any suitable detersive surfactant. The second surfactant may be selected from an anionic surfactant, a nonionic surfactant, a zwitterionic surfactant, an amphoteric surfactant, a cationic surfactant, or mixtures thereof, preferably an anionic, nonionic, or zwitterionic surfactant. The second surfactant may be selected from alkyl benzene sulfonate, ethoxylated alcohol nonionic surfactant, amine oxide, methyl ester sulfonate, glycolipid surfactant, alkylpolyglucoside surfactant, or combinations thereof. The second surfactant may be selected from the group consisting of an alkyl benzene sulfonate, an ethoxylated alcohol nonionic surfactant, an amine oxide surfactant, and mixtures thereof.

The second surfactant may comprise alkyl benzene sulfonate surfactant. The alkyl group may contain from about 9 to about 15 carbon atoms, in straight chain (linear) or branched chain configuration. The alkyl group may be linear. Such linear alkylbenzene sulfonates are known as "LAS." The linear alkylbenzene sulfonate may have an average number of carbon atoms in the alkyl group of from about 11 to 14. The linear straight chain alkyl benzene sulfonates may have an average number of carbon atoms in the alkyl group of about 11.8 carbon atoms, which may be abbreviated as C11.8 LAS. The alkyl benzene sulfonate may be present, at least partly, as a salt, such as an alkali metal salt, preferably a sodium salt, or an amine salt, such as an ethanolamine salt, e.g., an monoethanolamine salt.

The LAS may be present in an amount so that where the weight ratio of AES to LAS is from about 1:1, or from about 2:1, to about 10:1, or to about 8:1, or to about 5:1. The surfactant system may comprise less than 25%, or less than 10%, or less than 5%, or less than 1% of linear alkyl benzene sulfonate (LAS). As LAS typically provides cleaning benefits for hydrophobic stains, such as greasy stains, it may be preferred that in such cases of low levels of LAS (if any at all), the AES is characterized by an average degree of ethoxylation of from about 0.5 to about 3.0, or from about 0.5 to about 2.0, or from about 0.5 to about 1.5, as it is believed that lower degrees of AES ethoxylation may help to provide hydrophobic stain removal benefits.

The second surfactant may comprise an amine oxide surfactant. Preferred amine oxides are alkyl dimethyl amine oxide or alkyl amido propyl dimethyl amine oxide, more preferably alkyl dimethyl amine oxide and especially coco dimethyl amino oxide Amine oxide may have a linear or mid-branched alkyl moiety. Typical linear amine oxides include water-soluble amine oxides containing one R1 C8-18 alkyl moiety and 2 R2 and R3 moieties selected from the group consisting of C1-3 alkyl groups and C1-3 hydroxyalkyl groups. Preferably amine oxide is characterized by the formula R1—N(R2)(R3) O wherein R1 is a C8-18 alkyl and R2 and R3 are selected from the group consisting of methyl, ethyl, propyl, isopropyl, 2-hydroxyethyl, 2-hydroxypropyl and 3-hydroxypropyl. The linear amine oxide surfactants in particular may include linear C10-C18 alkyl dimethyl amine oxides and linear C8-C12 alkoxy ethyl dihydroxy ethyl amine oxides. Preferred amine oxides include linear C10, linear C10-C12, and linear C12-C14 alkyl dimethyl amine oxides. As used herein "mid-branched" means that the amine oxide has one alkyl moiety having n1 carbon atoms with one alkyl branch on the alkyl moiety having n2 carbon atoms. The alkyl branch is located on the a carbon from the nitrogen on the alkyl moiety. This type of branching for the amine oxide is also known in the art as an internal amine oxide. The compositions of the present disclosure may include from about 0.1% to about 5%, or to about 3%, or to about 1%, by weight of the composition, of amine oxide.

The second surfactant may comprise a nonionic surfactant. The nonionic surfactant may be an ethoxylated alcohol surfactant and/or ethoxylated alkyl phenols of the formula $R(OC_2H_4)_nOH$, wherein R is selected from the group consisting of aliphatic hydrocarbon radicals containing from about 8 to about 15 carbon atoms and alkyl phenyl radicals in which the alkyl groups contain from about 8 to about 12 carbon atoms, and the average value of n is from about 5 to about 15.

The nonionic surfactant may be an ethoxylated alcohol. For example, the nonionic surfactant may be selected from ethoxylated alcohols having an average of about 12-14 carbon atoms in the alcohol (alkyl) portion and an average degree of ethoxylation of about 7-9 moles of ethylene oxide per mole of alcohol.

Other non-limiting examples of nonionic surfactants may include: $C_{12}$-$C_{18}$ alkyl ethoxylates, such as, NEODOL® nonionic surfactants from Shell; $C_6$-$C_{12}$ alkyl phenol alkoxylates wherein the alkoxylate units are a mixture of ethyleneoxy and propyleneoxy units; $C_{12}$-$C_{18}$ alcohol and $C_6$-$C_{12}$ alkyl phenol condensates with ethylene oxide/propylene oxide block polymers such as Pluronic® from BASF; $C_{14}$-$C_{22}$ mid-chain branched alcohols; $C_{14}$-$C_{22}$ mid-chain branched alkyl alkoxylates, $BAE_x$, wherein x is from 1 to 30; alkylpolysaccharides, specifically alkylpolyglycosides; polyhydroxy fatty acid amides; and ether capped poly(oxyalkylated) alcohol surfactants.

The surfactant system may include surfactant may comprise a cationic surfactant. Non-limiting examples of cationic surfactants include: the quaternary ammonium surfactants, which can have up to 26 carbon atoms include:

alkoxylate quaternary ammonium (AQA) surfactants; dimethyl hydroxyethyl quaternary ammonium surfactants; dimethyl hydroxyethyl lauryl ammonium chloride; polyamine cationic surfactants; cationic ester surfactants; and amino surfactants, such as amido propyldimethyl amine (APA). The compositions of the present disclosure may be substantially free of cationic surfactants and/or of surfactants that become cationic below a pH of 7 or below a pH of 6, as cationic surfactants may negatively interact with other components, such as anionic surfactants.

The surfactant system may comprise a zwitterionic surfactant. Examples of zwitterionic surfactants include: derivatives of secondary and tertiary amines, derivatives of heterocyclic secondary and tertiary amines, or derivatives of quaternary ammonium, quaternary phosphonium or tertiary sulfonium compounds. The zwitterionic surfactants may comprise betaines, including alkyl dimethyl betaine, cocodimethyl amidopropyl betaine, and $C_8$ to $C_{18}$ (for example from $C_{12}$ to $C_{18}$) amine oxide and sulfo and hydroxy betaines, such as N-alkyl-N,N-dimethylammino-1-propane sulfonate where the alkyl group can be from $C_8$ to $C_{18}$ or from $C_{10}$ to $C_{14}$.

The surfactant system may include a branched surfactant. Suitable branched surfactant may comprise a non-sulfonated C12/13 alcohol-based surfactant comprising a methyl branch randomly distributed along the hydrophobe chain, e.g., Safol®, Marlipal® available from Sasol. Further suitable additional branched anionic detersive surfactants include non-sulfonated surfactants derived from alcohols branched in the 2-alkyl position, such as those sold under the trade names Isalchem®123, Isalchem®125, Isalchem®145, Isalchem®167, which are derived from the oxo process. Due to the oxo process, the branching is situated in the 2-alkyl position. These 2-alkyl branched alcohols are typically in the range of C11 to C14/C15 in length and comprise structural isomers that are all branched in the 2-alkyl position. Additional suitable non-sulfonated branched anionic detersive surfactants may include surfactant derivatives of isoprenoid-based polybranched detergent alcohols; branched surfactants derived from anteiso and iso-alcohols; and/or Guerbet-alcohol-based surfactants. The surfactant system may include other branched surfactants, such as modified alkylbenzene sulfonate (MLAS).

Other useful surfactants may include glycolipid surfactants, such as rhamolipids and/or sophorolipids. Such surfactants may be particularly useful because they may be naturally derived (e.g., from microorganisms).

Detergent Adjunct

The surfactant composition may further comprise at least one detergent adjunct. The detergent adjunct(s) may be present in the composition at levels suitable for the intended use of the composition. Typical usage levels range from as low as 0.001% by weight of composition for adjuncts such as optical brighteners to 50% by weight of composition for builders.

The at least one detergent adjunct may be selected from the group consisting of fatty acids and/or salts thereof, enzymes, encapsulated benefit agents, soil release polymers, hueing agents, builders, chelating agents, dye transfer inhibiting agents, dispersants, enzyme stabilizers, catalytic materials, bleaching agents, bleach catalysts, bleach activators, polymeric dispersing agents, soil removal/anti-redeposition agents, polymeric dispersing agents, polymeric grease cleaning agents, brighteners, suds suppressors, dyes, hueing agents, perfume, structure elasticizing agents, fabric softeners, carriers, fillers, hydrotropes, solvents, anti-microbial agents and/or preservatives, neutralizers and/or pH adjusting agents, processing aids, fillers, rheology modifiers or structurants, opacifiers, pearlescent agents, pigments, anti-corrosion and/or anti-tarnishing agents, and mixtures thereof. The at least one detergent adjunct may be at least one laundry adjunct selected from the group consisting of a structurant, a builder, a fabric softening agent, a polymer or an oligomer, an enzyme, an enzyme stabilizer, a bleach system, a brightener, a hueing agent, a chelating agent, a suds suppressor, a conditioning agent, a humectant, a perfume, a encapsulated perfume, a filler or carrier, an alkalinity system, a pH control system, a buffer, an alkanolamine, a solvent, and mixtures thereof.

The at least one detergent adjunct may include external structuring systems, enzymes, encapsulated benefit agents, soil release polymers, hueing agents, and mixtures thereof. The encapsulated benefit agent may be encapsulated perfume, preferably where the encapsulated perfume comprises a shell surrounding a core, preferably where the shell is free of amine compounds, preferably where the shell comprises acrylate polymers.

The compositions of the present disclosure may include solvent, preferably organic solvent, such as a non-amino-functional organic solvent. Suitable organic solvents may include glycerol, ethylene glycol, 1,3 propanediol, 1,2 propanediol, tetramethylene glycol, pentamethylene glycol, hexamethylene glycol, 2,3-butane diol, 1,3 butanediol, diethylene glycol, triethylene glycol, polyethylene glycol, glycerol formal dipropylene glycol, polypropylene glycol, dipropylene glycol n-butyl ether, and mixtures thereof. Solvents may be useful to help with stability and/or with tuning the viscosity to a desirable level.

The compositions of the present disclosure may comprise an alkoxylated polyalkyleneimine polymer, such as an alkoxylated polyethyleneimine (PEI) polymer as described above. Such PEI polymers may facilitate viscosity modification of the compositions. The alkoxylated polyalkyleneimine may be present in the composition at a level of from about 0.1% to about 5%, or from about 0.5% to about 4.5%, preferably from about 0.75% to about 1.5%, by weight of the composition. The alkoxylated polyalkyleneimine polymer, preferably alkoxylated PEI, may comprise ethoxylate (EO) groups, propoxylate (PO) groups, or combinations thereof. The alkoxylated polyalkyleneimine polymer, preferably alkoxylated PEI, may comprise ethoxylate (EO) groups. The alkoxylated polyalkyleneimine polymer, preferably alkoxylated PEI, may be free of propoxylate (PO) groups. The alkoxylated polyalkyleneimine polymer, preferably alkoxylated PEI, may comprise on average per alkoxylated nitrogen, about 1-50 ethoxylate (E0) groups and about 0-30 propoxylate (PO) groups. The alkoxylated polyalkylenimine may be linear, branched, or combinations thereof, preferably branched. Suitable alkoxylated polyalkyleneimines, such as PEI600 EO20 and/or PEI600 EO24 PO16, are available from BASF (Ludwigshafen, Germany).

It may be desirable to limit or even eliminate certain adjuncts, particularly if a detergent sourced primarily from natural or sustainable sources is desired. The detergent compositions of the present disclosure may be free of silicone, dye, brightener, or combinations thereof. The detergent compositions of the present disclosure may comprise less than 5%, or less than 3%, or less than 1%, by weight of the composition, of amine-containing compounds, with the proviso that amine oxide surfactant (if present) is not included in the total amount of amine-containing compounds.

As described above, the selection of the AES surfactant may help to build viscosity in certain detergent formulations.

Therefore, external structurants may not be required, particularly as they incur additional cost without providing performance benefits, such as stain removal. The detergent compositions of the present disclosure may be substantially free of external structurants. External structurants include polymeric structurants, non-polymeric crystalline hydroxy-functional structurants, microfibrillated cellulose (MFCs), or combinations thereof.

Inorganic salts, such as sodium chloride, are also often used to build viscosity in detergent compositions; however, such salts do not offer performance benefits, such as stain removal. Because the selection of the AES surfactant may help to build viscosity in certain detergent formulations, the liquid detergent compositions of the present disclosure may include no greater than about 2%, or no greater than about 1%, or no greater than about 0.5%, or no greater than about 1%, by weight of the liquid detergent composition, of inorganic salt.

Detergent Paste

The present disclosure also relates to detergent paste compositions. Such detergent pastes may include relatively concentrated amounts of AES surfactant. Such concentrated compositions are useful for saving transportation costs and for incorporation into product compositions at desired levels without bringing in much undesired and/or inactive material, such as carriers. The detergent paste may be combined with other surfactants and/or detergent adjuncts, resulting in detergent compositions, which may be according to the present disclosure.

The detergent pastes of the present disclosure may comprise from about from about 45%, or from about 50%, or from about 55%, to about 100%, or to about 90%, or to about 80%, or to about 70%, or to about 60%, by weight of the paste, of AES surfactant. The AES surfactant may comprise from about 40 wt % to about 70 wt %, by weight of the AES surfactant of C15 AES. The AES surfactant may comprise from about 15 wt % to about 40 wt %, by weight of the AES surfactant of C13 AES. The AES surfactant may be characterized by chain lengths having a weight average molecular weight of from about 200 to about 220 daltons, based on the molecular weight of a fatty alcohol comprising the alkyl chain. The AES surfactant may be further characterized by a weight average degree of ethoxylation of from about 0.5 to about 5. Suitable AES surfactants are described in more detail above.

The detergent paste compositions of the present disclosure may comprise from about 1%, or from about 2%, to about 25%, or to about 20%, or to about 15%, or to about 10%, or to about 5%, or to about 2%, by weight of the composition, of an additional material. For example, the paste may further comprise: a second surfactant such as alkyl benzene sulfonate surfactant; a caustic agent; an alkoxylated polyalkyleneimine (PEI) polymer; non-amino-functional organic solvent; water; or combinations thereof. The concentrated AES surfactant compositions may be substantially free of other detergent adjunct materials.

The detergent pastes according to the present disclosure may comprise alkyl benzene sulfonate surfactant, such as linear alkyl benzene sulfonate surfactant (LAS). The linear alkyl benzene sulfonate surfactant may present at a level of from about 0% to about 15%, or from about 2% to about 15%, or from about 5% to about 12%, by weight of the composition. LAS may facilitate viscosity modification of the detergent paste. The detergent paste compositions may be substantially free of other surfactants, such as other anionic, nonionic, amphoteric, cationic surfactants, and/or zwitterionic surfactants.

At least a portion of the concentrated AES surfactant may be neutralized, preferably with a caustic agent, such as sodium hydroxide. At least a portion of the concentrated AES surfactant may be present in salt form, preferably a sodium salt form.

The concentrated AES surfactant compositions of the present disclosure may comprise an alkoxylated polyalkyleneimine polymer, such as a PEI polymer as described above. Such PEI polymers may facilitate viscosity modification of the detergent paste. The alkoxylated polyalkyleneimine may be present in the composition at a level of from about 0.1% to about 5%, or from about 0.5% to about 4.5%, or from about 0.75% to about 1.5%, by weight of the concentrated AES surfactant composition.

The detergent paste may have a limited number of ingredients, which can maximize formulation flexibility in a final product (or in a plurality of final products). The concentrated AES surfactant may have no more than about 5 ingredients, or no more than about 4 ingredients, or not more than about 3 ingredients, not including reaction by-products or unreacted reactants that may be present in the composition.

Method of Making Detergent Compositions

The present disclosure relates to methods of making detergent compositions comprising the surfactant systems described herein. The method may include combining the components of the compositions described herein in the proportions described. The method may include making a first detergent composition comprising a first amount of the AES surfactant described herein, and a second detergent composition comprising a second amount of the AES surfactant described herein. The first and second detergent compositions may include For example, the process of making a detergent composition according to the present disclosure may include providing AES surfactant or detergent paste according to the present disclosure, optionally providing a second surfactant, and combining the surfactant(s) or paste with one or more detergent adjuncts to form the detergent composition. The AES surfactant may comprise from about 40 wt % to about 70 wt %, by weight of the AES surfactant, of an AES compound having fifteen carbon atoms in the alkyl chain ("C15 AES"). The AES surfactant may comprise no more than about 30 wt %, by weight of the AES surfactant, of an AES compound having fourteen carbon atoms in the alkyl chain ("C14 AES"). The AES surfactant may comprise from about 15 wt % to about 40 wt %, by weight of the AES surfactant, of an AES compound having thirteen carbon atoms in the alkyl chain ("C13 AES"). The AES surfactant may be characterized by chain lengths having a weight average molecular weight of from about 200 to about 220 daltons, based on the MW of a fatty alcohol comprising the alkyl chain. The AES surfactant may be further characterized by an average degree of ethoxylation of from about 0.5 to about 5.

The process of making a detergent composition may include the step of combining an AES surfactant according to the present disclosure (e.g., relatively rich in C15 AES) with a second AES surfactant (e.g., one that is less rich in C15 AES), an unethoxylated alkyl sulfate surfactant, or a combination thereof. Combining different samples of AES may provide additional stability and/or performance benefits.

Liquid compositions according to the present disclosure may be made according to conventional methods, for example in a batch process or in a continuous loop process.

The detergent compositions described herein may be encapsulated in a pouch, preferably a pouch made of water-soluble film, to form a unit dose article that may be used to treat fabrics. It is preferred that such compositions have relatively low amounts of water, for example less than about 20%, or less than about 15%, or less than about 12%, or less than about 10%, or less than about 8%, by weight of the detergent composition, of water.

Method of Using Detergent Compositions

The present disclosure relates to methods of using the detergent compositions described herein. The detergent compositions may be used to treat a surface, such as a fabric or a hard surface.

Methods of treating a surface may include the steps of: providing a surface, preferably a fabric, and contacting the surface with a detergent composition as described above. The surface, preferably a fabric, may comprise a greasy soil. The method may include agitating the fabric in the presence of water. The method may further comprise the step of carrying out a washing or cleaning operation. Water may be added before, during, or after the contacting step to form a wash liquor.

The present disclosure also relates to a process for the washing, for example by machine, of fabric, preferably soiled fabric, using a composition according to the present disclosure, comprising the steps of, placing a detergent composition according to the present disclosure into contact with the fabric to be washed, and carrying out a washing or cleaning operation.

Any suitable washing machine may be used, for example, a top-loading or front-loading automatic washing machine. Those skilled in the art will recognize suitable machines for the relevant wash operation. The article of the present disclosure may be used in combination with other compositions, such as fabric additives, fabric softeners, rinse aids, and the like. Additionally, the detergent compositions of the present disclosure may be used in known hand washing methods.

The present disclosure may also be directed to a method of treating a fabric, the method comprising the steps of contacting a fabric with a detergent composition described herein, carrying out a washing step, and then contacting the fabric with a fabric softening composition. The entire method, or at least the washing step, may be carried out by hand, be machine-assisted, or occur in an automatic washing machine. The step of contacting the fabric with a fabric softening composition may occur in the presence of water, for example during a rinse cycle of an automatic washing machine.

COMBINATIONS

Specifically contemplated combinations of the disclosure are herein described in the following lettered paragraphs. These combinations are intended to be illustrative in nature and are not intended to be limiting.

A. A liquid detergent composition comprising: from about 5% to less than 20%, by weight of the detergent composition, of a surfactant system, the surfactant system comprising alkyl ethoxylated sulfate ("AES") surfactant and a second surfactant, wherein the AES surfactant comprises a plurality of AES compounds, where each AES compound comprises an alkyl chain, wherein the AES surfactant comprises from about 40 wt % to about 70 wt %, by weight of the AES surfactant, of an AES compound having fifteen carbon atoms in the alkyl chain ("C15 AES"), wherein the AES surfactant comprises no more than about 30 wt %, by weight of the AES surfactant, of an AES compound having fourteen carbon atoms in the alkyl chain ("C14 AES"), wherein the AES surfactant is characterized by chain lengths having a weight average molecular weight ("MW") of from about 200 to about 220 daltons, based on the MW of a fatty alcohol comprising the alkyl chain; and a detergent adjunct.

B. A liquid detergent composition according to paragraph A, wherein the composition comprises from about 5% to about 17%, or from about 8% to about 15%, or from about 10% to about 15%, by weight of the detergent composition, of the surfactant system.

C. A liquid detergent composition according to any of paragraphs A-B, wherein the surfactant system comprises at least about 30%, preferably at least about 60%, by weight of the surfactant composition, of AES surfactant.

D. A liquid detergent composition according to any of paragraphs A-C, wherein the AES surfactant comprises from about 45 wt % to about 60 wt %, preferably from about 50 wt % to about 60 wt %, by weight of the AES surfactant, of C15 AES.

E. A liquid detergent composition according to any of paragraphs A-D, wherein the AES surfactant comprises an AES compound having twelve carbon atoms in the alkyl chain ("C12 AES"), an AES compound having thirteen carbon atoms in the alkyl chain ("C13 AES"), or mixtures thereof.

F. A liquid detergent composition according to any of paragraphs A-E, wherein the AES surfactant comprises from about 25% to about 50%, by weight of the AES surfactant, of a mixture of C12 AES and C13 AES.

G. A liquid detergent composition according to any of paragraphs A-F, wherein the AES surfactant comprises from about 15 wt % to about 50 wt %, or from about 25 wt % to about 50 wt %, or from about 25 wt % to about 40 wt %, or from about 30 wt % to about 40 wt %, by weight of the AES surfactant, of an AES compound having thirteen carbon atoms in the alkyl chain ("C13 AES").

H. A liquid detergent composition according to any of paragraphs A-G, wherein the AES surfactant comprises no more than about 25%, or no more than about 20%, or no more than about 15%, or no more than about 10%, by weight of the AES surfactant, of C14 AES.

I. A liquid detergent composition according to any of paragraphs A-H, wherein the AES surfactant further comprises at least 1%, by weight of the AES surfactant, of each of C12 AES, C13 AES, and C14 AES.

J. A liquid detergent composition according to any of paragraphs A-I, wherein the AES surfactant is characterized by chain lengths having a weight average molecular weight of from about 210 to about 220 daltons, preferably from about 211 to about 218 daltons.

K. A liquid detergent composition according to any of paragraphs A-J, wherein the AES surfactant is characterized by an average degree of ethoxylation of from about 0.5 to about 5, or from about 1 to about 3, or from about 1.5 to about 2.5.

L. A liquid detergent composition according to any of paragraphs A-K, wherein from about 10% to about 30%, by weight of the AES surfactant, of the AES surfactant is branched at the C2 position.

M. A liquid detergent composition according to any of paragraphs A-L, wherein the second surfactant is selected from the group consisting of an alkyl benzene sulfonate, an ethoxylated alcohol nonionic surfactant, an amine oxide surfactant, and mixtures thereof.

N. A liquid detergent composition according to any of paragraphs A-M, wherein the second surfactant comprises alkyl benzene sulphonate, preferably linear alkyl benzene sulphonate ("LAS").

O. A liquid detergent composition according to paragraph N, wherein the LAS is present in an amount so that the weight ratio of AES to LAS is from about 1:1 to about 10:1, preferably about 2:1 to about 5:1.

P. A liquid detergent composition according to any of paragraphs A-O, wherein the composition is characterized by a viscosity of from about 200 to about 800 cps at $20s^{-1}$ and at 20° C.

Q. A liquid detergent composition according to any of paragraphs A-P, wherein the detergent adjunct is selected from fatty acids and/or salts thereof, enzymes, encapsulated benefit agents, soil release polymers, hueing agents, builders, chelating agents, dye transfer inhibiting agents, dispersants, enzyme stabilizers, catalytic materials, bleaching agents, bleach catalysts, bleach activators, polymeric dispersing agents, soil removal/anti-redeposition agents, polymeric dispersing agents, polymeric grease cleaning agents, brighteners, suds suppressors, dyes, hueing agents, perfume, structure elasticizing agents, fabric softeners, carriers, fillers, hydrotropes, solvents, anti-microbial agents and/or preservatives, neutralizers and/or pH adjusting agents, processing aids, fillers, rheology modifiers or structurants, opacifiers, pearlescent agents, pigments, anti-corrosion and/or anti-tarnishing agents, and mixtures thereof.

R. A liquid detergent composition according to any of paragraphs A-Q, wherein the detergent adjunct comprises an alkoxylated polyethylenimine (PEI) polymer.

S. A liquid detergent composition according to any of paragraphs A-R, wherein the liquid detergent comprises no greater than about 2%, by weight of the composition, of inorganic salt.

T. A liquid detergent composition according to any of paragraphs A-S, wherein the liquid detergent is a fabric care composition.

U. A liquid detergent composition comprising: a surfactant system, the surfactant system comprising alkyl ether sulfate (AES) surfactant and a second surfactant, wherein the AES surfactant comprises a plurality of AES compounds, where each AES compound comprises an alkyl chain, wherein the AES surfactant comprises from about 40 wt % to about 70 wt %, by weight of the AES surfactant, of an AES compound having fifteen carbon atoms in the alkyl chain ("C15 AES"), wherein the AES surfactant comprises no more than about 30 wt %, by weight of the AES surfactant, of an AES compound having fourteen carbon atoms in the alkyl chain ("C14 AES"), wherein the AES surfactant is characterized by chain lengths having a weight average molecular weight of from about 208 to no greater than 215 daltons, based on the MW of a fatty alcohol comprising the alkyl chain, wherein the AES surfactant is further characterized by an average degree of ethoxylation of from about 0.5 to about 5; and a detergent adjunct.

V. A detergent paste comprising: from about 45% to about 100%, by weight of the paste, of AES surfactant, where the AES surfactant comprises a plurality of AES compounds, where each AES compound comprises an alkyl chain, wherein the AES surfactant comprises from about 40 wt % to about 70 wt %, by weight of the AES surfactant, of an AES compound having fifteen carbon atoms in the alkyl chain ("C15 AES"), and wherein the AES surfactant comprises no more than about 30%, by weight of the AES surfactant, of an AES compound having fourteen carbon atoms in the alkyl chain ("C14 AES"), wherein the AES surfactant is characterized by chain lengths having a weight average molecular weight of from about 200 to about 220 daltons, based on the MW of a fatty alcohol comprising the alkyl chain, wherein the AES surfactant is further characterized by an average degree of ethoxylation of from about 0.5 to about 5; optionally, the paste further comprising alkyl benzene sulphonate surfactant, a caustic agent, an alkoxylated polyalkyleneimine (PEI) polymer, non-aminofunctional organic solvent, water, or combinations thereof.

TEST METHODS

Percent Transmittance

The Percent Transmittance is measured with a UV-Visible spectrometer such as a Beckman Coulter DU® 800. A standard 10 mm pathlength cuvette is used for the sample measurement and compared to a deionized water blank. Samples are measured in the in the absence of dyes and/or opacifiers, and at a temperature of 20° C.±2° C.

pH

Unless otherwise stated herein, the pH of the composition is defined as the pH of an aqueous 10% (weight/volume) solution of the composition at 20±2° C. Any meter capable of measuring pH to ±0.01 pH units is suitable. Orion meters (Thermo Scientific, Clintinpark—Keppekouter, Ninovesteenweg 198, 9320 Erembodegem—Aalst, Belgium) or equivalent are acceptable instruments. The pH meter should be equipped with a suitable glass electrode with calomel or silver/silver chloride reference. An example includes Mettler DB 115. The electrode should be stored in the manufacturer's recommended electrolyte solution.

The 10% aqueous solution of the detergent is prepared according to the following procedure. A sample of 10±0.05 grams is weighted with a balance capable of accurately measuring to ±0.02 grams. The sample is transferred to a 100 mL volumetric flask, diluted to volume with purified water (deionized and/or distilled water are suitable as long as the conductivity of the water is <5 μS/cm), and thoroughly mixed. About 50 mL of the resulting solution is poured into a beaker, the temperature is adjusted to 20±2 ° C. and the pH is measured according to the standard procedure of the pH meter manufacturer. The manufacturer's instructions should be followed to set up and calibrate the pH assembly.

Determination of the Average Alkyl Chain Length

The average alkyl chain length of a surfactant, or of a precursor alcohol, is often reported by surfactant suppliers. One of ordinary skill will understand that average alkyl chain length of a sulfated or sulfonated surfactant may be determined and/or reported in terms of the feedstock alcohol.

In the case that only the chain length distribution on a mass basis is reported, the average alkyl chain length can be calculated by the following equation:

$$\text{Average Alkyl Chain length}=(\Sigma CL_i)/(\Sigma(X_i/CL_i))$$

where $X_i$ is the mass fraction of each chain length, $CL_i$.

If the chain length distribution is not available from the surfactant supplier, the chain length distribution can be determined via Gas Chromatography as described in *Analysis of Surfactants,* Second Edition Thomas Schmitt, CRC Press, 2001, pg. 29. If the only the sulfated alcohol is available, the sulfate may be converted to alkyliodides by decomposition with hydroiodic acid solution. (Lee and Putnam, J. Am. Oil Chem. Soc. 43:690 (1966)). The alkyliodides derivatives then are readily characterized for chain-length via Gas Chromatography.

EXAMPLES

The examples provided below are intended to be illustrative in nature and are not intended to be limiting.

Example 1. AES Compositions

Exemplary AES compositions are shown below in Table 2. Compositions A and C are comparative examples, having equal amounts of C14 and C15 alkyl chains and relatively low amounts of C13 alkyl chains. Compositions B and D are AES compositions according to the present disclosure and are relatively rich in both C13 and C15 alkyl chains.

TABLE 2

| | Alkyl Chain Length Distribution (wt %) | | | | | | |
|---|---|---|---|---|---|---|---|
| AES | C12 | C13 | C14 | C15 | C16 | Avg. EO | Avg. MW |
| A[1] (comp.) | 14.4 | 13.4 | 35.7 | 35.7 | 0.9 | 1.9 | 211 |
| B[1] | 11.4 | 33.3 | 4.3 | 50.2 | 0.9 | 1.9 | 211 |
| C (comp.) | 7.5 | 7.5 | 42.0 | 42.0 | 1.0 | 2.5 | 216 |
| D | 4.0 | 31.0 | 5.0 | 59.0 | 1.0 | 2.5 | 216 |
| E | 3.1 | 27.1 | 5.8 | 63.6 | 0.4 | 2.5 | 217 |
| F | 15.0 | 16.7 | 10.5 | 57.6 | 0.3 | 2.5 | 214 |
| G | 3.1 | 27.6 | 28.2 | 40.8 | 0.3 | 2.5 | 214 |
| H | 7.1 | 32.5 | 4.5 | 55.8 | 0.1 | 2.5 | 214 |

[1]AES compositions A and B are mixtures of 85 wt % of AE2.5S and 15% unethoxylated alkyl sulfate having C12 and C13 alkyl chains Example 2. Viscosity Effects Resulting from Differing AES Chain Length Distributions Various liquid detergent compositions are prepared (Detergents 1-11); each composition includes different adjuncts and/or levels of adjuncts, but the surfactant systems of each are shown below in Table 3. The detergents are listed in order of decreasing total surfactant amounts.

Two versions of each detergent composition are prepared—one with AES "A" and one with AES "B," according to Example 1.

The resulting compositions are stored for two weeks 40° C. At the end of the storage period, the viscosities of each composition are measured using a Brookfield viscometer, No. 2 spindle, at 60 RPM/s, at 20° C. The viscosity measurements, as well as the differences in viscosity between the compositions that include the "A" AES surfactant compared to the "B" AES surfactant, are shown below in Table 3.

TABLE 3

| Detergent | AES, % (A or B) | LAS, % | Non-ionic, % | Amine oxide, % | Total Surfactant, % | Viscosity in cps ("A" leg) | Viscosity in cps ("B" leg) | Delta Viscosity in cps (B vs. A) | Delta Viscosity (% increase) |
|---|---|---|---|---|---|---|---|---|---|
| 1 | 27.2 | 8.7 | 0.0 | 1.6 | 37.6 | 464 | 485 | +21 | 4.5% |
| 2 | 24.3 | 8.1 | 2.0 | 1.4 | 35.8 | 395 | 400 | +5 | 1.3% |
| 3 | 20.4 | 11.9 | 0.0 | 1.2 | 33.6 | 341 | 352 | +11 | 3.2% |
| 4 | 14.9 | 9.0 | 5.0 | 0.9 | 29.7 | 251 | 272 | +21 | 8.4% |
| 5 | 18.4 | 2.7 | 5.4 | 0.0 | 26.5 | 928 | 1232 | +304 | 33% |
| 6 | 11.8 | 7.3 | 5.0 | 0.7 | 24.7 | 379 | 400 | +21 | 5.5% |
| 7 | 14.0 | 2.0 | 4.1 | 0.0 | 20.1 | 699 | 731 | +32 | 4.6% |
| 8 | 11.4 | 2.8 | 0.0 | 0.0 | 14.3 | 416 | 768 | +352 | 84.6% |
| 9 | 10.2 | 2.5 | 0.0 | 0.7 | 13.5 | 453 | 747 | +293 | 64.9% |
| 10 | 8.2 | 2.0 | 0.0 | 0.0 | 10.2 | 240 | 395 | +155 | 64.6% |
| 11 | 7.4 | 2.1 | 0.0 | 0.5 | 10.1 | 491 | 837 | +347 | 70.5% |

As shown in Table 3, viscosities of the detergent compositions typically increase when the "A" AES surfactant is substituted with the "B" AES surfactant. Furthermore, detergent compositions that include relatively low levels of surfactant (e.g., less than 20%) show significant increases in viscosity (e.g., greater than 50%) when the "A" AES surfactant is substituted with the "B" AES surfactant; see, for example, detergent examples 8-11.

Example 3. Physical Stability

Three samples each of detergent formulations 2 and 7, according to Example 2, are prepared. Each sample uses a different AES composition: A, B, and D, according to Example 1. The surfactant systems of each are provided below in Table 4; values are provided as wt % of the total composition.

The samples are stored at 25° C. and 10° C., and then visually assessed for physical stability. Clear formulations are considered stable, whereas haziness indicates a lack of physical stability.

TABLE 4

| | 12 | 13 | 14 | 15 | 16 | 17 |
|---|---|---|---|---|---|---|
| AES A (MW = 211) | 24.3 | — | — | 14.0 | — | — |
| AES B (MW = 211) | — | 24.3 | — | — | 14.0 | — |
| AES D (MW = 216) | — | — | 24.3 | — | — | 14.0 |
| LAS | 8.1 | 8.1 | 8.1 | 2.0 | 2.0 | 2.0 |
| Nonionic | 2.0 | 2.0 | 2.0 | 4.1 | 4.1 | 4.1 |
| Amine oxide | 1.4 | 1.4 | 1.4 | 0.0 | 0.0 | 0.0 |
| Total surfactant | 35.8 | 35.8 | 35.8 | 20.1 | 20.1 | 20.1 |
| Stability at 25° C. | Clear | Clear | Clear | Clear | Clear | Clear |
| Stability at 10° C. | Clear | Clear | Hazy | Clear | Clear | Hazy |

As shown in Table 4, both AES A and AES B result in products that appear physically stable at both 25° C. and 10° C. However, some products made with AES D appear hazy at 10° C., indicating a lack of physical stability.

To note, both AES B and AES D are rich in C13 and C15 AES. It is surprising that a relatively small change in chain length distribution, evidenced by the difference in molecular weights (211 vs. 216), would result in such a difference in physical stability in a final product detergent. Without wishing to be bound by theory, it is believed that the greater degree of hydrophobicity of the longer alkyl chain lengths contributes to the physical instability.

Furthermore, it is believed that AES B (exemplified in examples 13 and 16) will be more advantageous to the detergent manufacturer than AES A, as it may provide greater formulation flexibility across a variety of products. For example, as shown in Example 2, AES B, which has a higher proportions of C15 AES and, e.g., C13 AES compared to AES A, helps to build viscosity, particularly in formulations that are relatively low in surfactant. The manufacturer, then, may use a single source of AES surfactant to formulate both high and low detergent compositions, reducing raw material complexity.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A liquid detergent composition comprising:

from about 5% to less than 20%, by weight of the detergent composition, of a surfactant system, the surfactant system comprising alkyl ethoxylated sulfate surfactant and a second surfactant, wherein the alkyl ethoxylated sulfate surfactant comprises a plurality of alkyl ethoxylated sulfate compounds, where each alkyl ethoxylated sulfate compound comprises an alkyl chain, wherein the alkyl ethoxylated sulfate surfactant comprises from about 40 wt % to about 70 wt %, by weight of the alkyl ethoxylated sulfate surfactant, of an alkyl ethoxylated sulfate compound having fifteen carbon atoms in the alkyl chain, wherein the alkyl ethoxylated sulfate surfactant comprises no more than about 30 wt %, by weight of the alkyl ethoxylated sulfate surfactant, of an alkyl ethoxylated sulfate compound having fourteen carbon atoms in the alkyl chain, wherein the alkyl ethoxylated sulfate surfactant comprises from about 15% to about 50%, by weight of the alkyl ethoxylated sulfate surfactant, of an alkyl ethoxylated sulfate compound having thirteen carbon atoms in the alkyl chain:

wherein the alkyl ethoxylated sulfate surfactant is characterized by chain lengths having a weight average molecular weight of from about 200 to about 220 daltons, based on the weight average molecular weight of a fatty alcohol comprising the alkyl chain; and a detergent adjunct.

2. A liquid detergent composition according to claim 1, wherein the alkyl ethoxylated sulfate surfactant comprises from about 45 wt % to about 65 wt % by weight of the alkyl ethoxylated sulfate surfactant, of the alkyl ethoxylated sulfate compound having fifteen carbon atoms in the alkyl chain.

3. A liquid detergent composition according to claim 1, wherein the alkyl ethoxylated sulfate surfactant comprises an alkyl ethoxylated sulfate compound having twelve carbon atoms in the alkyl chain, an alkyl ethoxylated sulfate compound having thirteen carbon atoms in the alkyl chain, or mixtures thereof.

4. A liquid detergent composition according to claim 3, wherein the alkyl ethoxylated sulfate surfactant comprises from about 25% to about 50%, by weight of the alkyl ethoxylated sulfate surfactant, of a mixture of an alkyl ethoxylated sulfate compound having twelve carbon atoms in the alkyl chain and the alkyl ethoxylated sulfate compound having thirteen carbon atoms in the alkyl chain.

5. A liquid detergent composition according to claim 1, wherein the alkyl ethoxylated sulfate surfactant comprises no more than about 25% by weight of the alkyl ethoxylated sulfate surfactant, of the alkyl ethoxylated sulfate compound having fourteen carbon atoms in the alkyl chain.

6. A liquid detergent composition according to claim 1, wherein the alkyl ethoxylated sulfate surfactant further comprises at least 1%, by weight of the alkyl ethoxylated sulfate surfactant, of an alkyl ethoxylated sulfate compound having twelve carbon atoms in the alkyl chain, and the alkyl ethoxylated sulfate compound having fourteen carbon atoms in the alkyl chain.

7. A liquid detergent composition according to claim 1, wherein the alkyl ethoxylated sulfate surfactant is characterized by chain lengths having a weight average molecular weight of from about 210 to about 220 daltons.

8. A liquid detergent composition according to claim 1, wherein the alkyl ethoxylated sulfate surfactant is characterized by an average degree of ethoxylation of from about 0.5 to about 5.

9. A liquid detergent composition according to claim 1, wherein from about 10% to about 30%, by weight of the alkyl ethoxylated sulfate surfactant, of the alkyl ethoxylated sulfate surfactant is branched at the C2 position.

10. A liquid detergent composition according to claim 1, wherein the second surfactant is selected from the group consisting of an alkyl benzene sulfonate, an ethoxylated alcohol nonionic surfactant, an amine oxide surfactant, and mixtures thereof.

11. A liquid detergent composition according to claim 1, wherein the second surfactant comprises a linear alkyl benzene sulphonate.

12. A liquid detergent composition according to claim 11, wherein the linear alkyl benzene sulphonate is present in an amount so that the weight ratio of alkyl ethoxylated sulfate to linear alkyl benzene sulphonate is from about 1:1 to about 10:1.

13. A liquid detergent composition according to claim 1, wherein the composition is characterized by a viscosity of from about 200 to about 1400 cps at 200 and at 20° C.

14. A liquid detergent composition according to claim 1, wherein the detergent adjunct is selected from fatty acids and/or salts thereof, enzymes, encapsulated benefit agents, soil release polymers, hueing agents, builders, chelating agents, dye transfer inhibiting agents, dispersants, enzyme stabilizers, catalytic materials, bleaching agents, bleach catalysts, bleach activators, polymeric dispersing agents, soil removal/anti-redeposition agents, polymeric dispersing agents, polymeric grease cleaning agents, brighteners, suds suppressors, dyes, hueing agents, perfume, structure elasticizing agents, fabric softeners, carriers, fillers, hydrotropes, solvents, anti-microbial agents and/or preservatives, neutralizers and/or pH adjusting agents, processing aids, fillers, rheology modifiers or structurants, opacifiers, pearlescent agents, pigments, anti-corrosion and/or anti-tarnishing agents, and mixtures thereof.

15. A liquid detergent composition according to claim 1, wherein the detergent adjunct comprises an alkoxylated polyethylenimine polymer.

16. A liquid detergent composition according to claim 1, wherein the liquid detergent comprises no greater than about 2%, by weight of the composition, of inorganic salt.

17. A liquid detergent composition according to claim 1, wherein the liquid detergent is a fabric care composition.

18. A liquid detergent composition comprising:

a surfactant system, the surfactant system comprising alkyl ether sulfate surfactant and a second surfactant, wherein the alkyl ethoxylated sulfate surfactant comprises a plurality of alkyl ethoxylated sulfate compounds, where each alkyl ethoxylated sulfate compound comprises an alkyl chain, wherein the alkyl ethoxylated sulfate surfactant comprises from about 40 wt % to about 70 wt %, by weight of the alkyl ethoxylated sulfate surfactant, of an alkyl ethoxylated sulfate compound having fifteen carbon atoms in the alkyl chain, wherein the alkyl ethoxylated sulfate surfactant comprises no more than about 30 wt %, by weight of the alkyl ethoxylated sulfate surfactant, of an alkyl ethoxylated sulfate compound having fourteen carbon atoms in the alkyl chain, wherein the alkyl ethoxylated sulfate surfactant comprises from about 15% to about 50%, by weight of the alkyl ethoxylated sulfate surfactant, of an alkyl ethoxylated sulfate compound having thirteen carbon atoms in the alkyl chain;

wherein the alkyl ethoxylated sulfate surfactant is characterized by chain lengths having a weight average molecular weight of from about 208 to no greater than 215 daltons, based on the weight average molecular weight of a fatty alcohol comprising the alkyl chain, wherein the alkyl ethoxylated sulfate surfactant is further characterized by an average degree of ethoxylation of from about 0.5 to about 5; and a detergent adjunct.

19. A detergent paste comprising:

from about 45% to about 100%, by weight of the paste, of alkyl ethoxylated sulfate surfactant, where the alkyl ethoxylated sulfate surfactant comprises a plurality of alkyl ethoxylated sulfate compounds, where each alkyl ethoxylated sulfate compound comprises an alkyl chain, wherein the alkyl ethoxylated sulfate surfactant comprises from about 40 wt % to about 70 wt %, by weight of the alkyl ethoxylated sulfate surfactant, of an alkyl ethoxylated sulfate compound having fifteen carbon atoms in the alkyl chain, and wherein the alkyl ethoxylated sulfate surfactant comprises no more than about 30%, by weight of the alkyl ethoxylated sulfate surfactant, of an alkyl ethoxylated sulfate compound having fourteen carbon atoms in the alkyl chain, wherein the alkyl ethoxylated sulfate surfactant comprises from about 15% to about 50%, by weight of the alkyl ethoxylated sulfate surfactant, of an alkyl ethoxylated sulfate compound having thirteen carbon atoms in the alkyl chain;

wherein the alkyl ethoxylated sulfate surfactant is characterized by chain lengths having a weight average molecular weight of from about 200 to about 220 daltons, based on the weight average molecular weight of a fatty alcohol comprising the alkyl chain, wherein the alkyl ethoxylated sulfate surfactant is further characterized by an average degree of ethoxylation of from about 0.5 to about 5;

optionally, the paste further comprising alkyl benzene sulphonate surfactant, a caustic agent, an alkoxylated polyalkyleneimine polymer, non-aminofunctional organic solvent, water, or combinations thereof.

* * * * *